US005136866A

United States Patent [19]

Lisciani

[11] Patent Number: 5,136,866

[45] Date of Patent: Aug. 11, 1992

[54] NON-SLIP RECTILINEAR WIREDRAWING MACHINE WITH SYNCHRONIZATION BETWEEN SUCCESSIVE TANGENTIALLY UNCOILING CAPSTANS

[75] Inventor: Giulio Lisciani, Grottammare, Italy

[73] Assignee: R. Lisciani Trailerie E. Divisione Dyn Automazione Industriale S.n.c., Grottammare, Italy

[21] Appl. No.: 667,416

[22] Filed: Mar. 11, 1991

[30] Foreign Application Priority Data

Mar. 21, 1990 [IT] Italy ..... 3403 A/90

[51] Int. Cl.[5] ..... B21C 1/12

[52] U.S. Cl. ..... 72/8; 72/280; 72/288; 72/289

[58] Field of Search ..... 72/280, 279, 288, 289, 72/21, 8

[56] References Cited

U.S. PATENT DOCUMENTS

| | | | |
|---|---|---|---|
| 2,960,215 | 11/1960 | Rehnqvist | 72/279 |
| 3,750,449 | 8/1973 | Rabe | 72/289 |
| 4,079,609 | 3/1978 | Hodgskiss | 72/6 |
| 4,252,010 | 2/1981 | Rossi | 72/288 |
| 4,511,096 | 4/1985 | Dufries | 72/289 |
| 4,604,883 | 8/1986 | Schaetzke | 72/21 |
| 4,754,633 | 7/1988 | Glover | 72/288 |

FOREIGN PATENT DOCUMENTS 2008009 5/1979 United Kingdom .

*Primary Examiner*—Daniel C. Crane

*Attorney, Agent, or Firm*—Dvorak and Traub

[57] ABSTRACT

In a non-slip rectilinear wiredrawing machine with tangentially uncoiling capstans, each capstan is composed of two concentric and coaxial parts, the first of which driven by a motor and comprising the typical capstan pulling face, the second part a freely-revolving ring affording a run-out from which the wire is drawn through a die by and onto a successive capstan; the speed of the individual capstans is synchronized by a device capable of monitoring both the angular movement of the shaft driving the first part of the capstan and the angular movement of the ring, detecting any difference between the two, and correcting the angular velocity of the shaft accordingly.

10 Claims, 2 Drawing Sheets

NON-SLIP RECTILINEAR WIREDRAWING MACHINE WITH SYNCHRONIZATION BETWEEN SUCCESSIVE TANGENTIALLY UNCOILING CAPSTANS

BACKGROUND OF THE INVENTION

The present invention relates to a non-slip type rectilinear wiredrawing machine with tangentially uncoiling capstans incorporating a synchronization device between each two successive capstans.

Conventionally, in a multiple drawing machine for the manufacture of metal wire, where each drawing step reduces the diameter of the wire by a given percentage of its rounded section, the fundamental difficulty encountered is that of synchronizing the rotational speeds of the capstans, which in essence function as collect-and-feed stations intercalated with the successive drawing dies or plates in such a way as to ensure a steady flow of material. Thus, expressing the velocity and section of the wire per drawing step (n) as Vn and Sn, it must be ensured that $Sn \times Vn = k$.

The product of section multiplied by speed, i.e. the volume of the flow of material, must in effect remain constant from one step to the next. Given therefore that the section of the wire is dependent on the diameter of the drawing die or plate located between capstans, and that this same diameter will be subject to an unpredictable and uncontrollable degree of variation through wear during production, a correction can be effected only by varying the velocity of the wire which, in the non-slip type of drawing machine (i.e. where the capstan carries a significant number of single coils of wire, thereby disallowing relative movement between capstan and material), is equivalent to the peripheral surface speed of the capstans.

In multiple machines such as the Morgan and similar types, the wire is wound spirally onto cylindrical capstans and uncoiled in an axial direction from the capstan. Synchronization is achieved in such machines, necessarily, by operating the capstans intermittently, and while the flow of material is rendered steady in this manner, the result is but modestly successful. The main limitations of such machines stem from the need for intermittent type operation on the one hand, and on the other, from the fact that the wire is subjected to undesirable stresses; in effect, the wire is twisted through a full revolution with each coil paid out from the capstan, by reason of the axial uncoiling action. Moreover, these axially uncoiling machines require a device by means of which to transfer the running wire from one capstan to the next (an 'uncoiler', in effect), which comprises pulleys positioned one alongside and another elevated axially from the capstan, serving to direct the wire toward and into the drawing die preceding the next capstan.

In a variation on this type of machine, designed to prevent twisting of the wire (which is undesirable in any event, but absolutely to be avoided when drawing steel with a high carbon content), use is made of two capstans positioned one above the other with a single transfer pulley located in between that enables the wire to run off the second capstan tangentially instead of axially. The drawback of intermittent operation remains in such machines, however, in addition to the considerable structural complications that arise with two capstans to each drawing step.

With the advent of d.c. capstan drive motors, it has been possible to update these machines to newer technological standards; accordingly, the "stop/go" type of intermittent operation can be improved to "slow/fast", and by incorporating further special expedients and transducers, continuous and entirely intermittence-free operation can also be achieved. Also, the use of variable speed converters has led to the embodiment of new rectilinear wiredrawing machines in which the wire passes directly from one capstan to the next. The number of coils passing round each capstan remains fixed, and absolutely no twisting occurs in passage of the wire from step to step.

The capstans themselves are of frustoconical shape, exhibiting a gentle taper that enables and favors an orderly and substantially non-overlapping coil along the winding surface between the pulling face where the wire enters into full contact with the surface, and the run-out face at the very top of the capstan. Accordingly, the wire can be made to uncoil tangentially from such a capstan.

In the rectilinear machine, there is no slippage between the wire and the capstan face, so that the velocity of the wire coincides with the surface speed of the capstan. This automatically dictates the need to govern the tension of the wire between capstan; the necessary control is obtained in most instances by locating a jockey, or dancer, between one capstan and the next, and more exactly, between the exit of each capstan and the drawing die or plate next in sequence, positioned in such a way as to react to any geometrical variation in a loop of wire created between the two capstans for the very purpose in question. The dancer combines with a suitable transducer, of which the response varies with oscillation induced by changes in tension of the wire, to create a control medium of which the corresponding variation in output can be used to correct the speed of the interlocked capstan. In rectilinear machines of the type in question, the wire generally needs to be directed around one or more pulleys before entering the drawing die associated with the following capstan, in order to create a degree of slack sufficient to accommodate the excursion of the dancer; this results in a certain degree of drag on the loop of wire, of which the force will depend on the mechanical load applied to the dancer. Moreover, these pulleys are generally of diameter much smaller than that of the capstan, especially when installed in any number, so that the wire is subjected to a succession of alternate bending stresses; such an effect is not only undesirable, but especially damaging when the wire is still relatively thick during the initial drawing steps, or when operating with particularly large nominal production diameters. Conversely, if the dancer mechanism is reduced to a simple sensor monitoring a single loop of wire located between two capstans, the resulting control becomes so highly sensitive as to produce a critical operating characteristic, and flexibility is lost. Thus, notwithstanding the advantage of affording a speed control facility, even the rectilinear type of wiredrawing machine betrays not inconsiderable drawbacks.

Capstan speed can be governed by monitoring torque rather than speed, however, and this is the method adopted in a further type of machine in which speed is compensated by drag. The advantage of these machines consists in the fact that one has a direct transfer of the wire from one capstan to another, without dancers or other such devices; in practical terms, the wire passes directly from one capstan to the drawing die located between this and the next capstan. Synchronization is achieved automatically inasmuch as the drive of the interlocked capstan will not deliver the total required drawing torque, but a given proportion thereof, insufficient in any event to set the capstan in rotation. The remaining proportion is provided by the capstan next in line by way of the interconnecting wire, which generates the drag necessary to compensate the shortfall. The effect is passed on down to the final capstan in line, which, being speed-controlled, automatically determines the speed of all the preceding capstans. Whilst there are no problems with transfer of the wire from one capstan to the next in such machines, the compensating drag cannot be metered accurately to match the effective requirement, and the risk of the wire breaking is therefore greatly increased in consequence.

Furthermore, the matching of speeds between one capstan and the next is markedly rigid, given the absence of any margin of tolerance, or of any flow compensating means by which to take up the minute variations in velocity between capstans caused by an irregular flow of material.

Finally, optimum torque-metering of the capstan drive motors can indeed be obtained using special transducers (strain gages) placed in contact with the wire at a point prior to its entering each die, which convert the detectable degree of drag into a given output signal. This results in a particularly complex and delicate system, however, and does not ultimately eliminate the risk of wire rupture. The object of the present invention is to overcome the drawbacks mentioned above.

SUMMARY OF THE INVENTION

The stated object is realized in a rectilinear wiredrawing machine with tangentially uncoiling capstans according to the present invention, in which each capstan is composed of two concentric and coaxial parts, the first driven by a motor and comprising the typical capstan pulling face, the second embodied as a freely-revolving tubular ring affording a run-out face from which the wire is drawn through a die by and onto the next capstan; the speed of the single capstans is synchronized by a device capable of monitoring the angular movement both of the power driven first part of each capstan and of the freely-revolving ring, detecting any difference between the two, and adjusting the speed of the motor accordingly. The wire passes direct from one capstan to the next encountering nothing other than a drawing die or plate, eliminating any undesirable stress on the wire, and in addition, eliminating any risk of the wire breaking as occurs typically in a drag compensated machine. Thus, for the first time, the problem of efficient synchronization is properly addressed and resolved by controlling speed, through without exerting any stress on the wire; rather, the coiling action is affected in geometrically controlled conditions, with a margin of tolerance sufficient to safeguard the integrity of the wire at any given moment of the synchronization process.

Among the advantages of the present invention is that it combines the positive features of a dancer speed controlled rectilinear machine and those of a torque controlled drag compensated type.

Another advantage of the machine disclosed is that of its especial simplicity in construction, whereby synchronization is entrusted to an uncomplicated electromechanical control obtainable essentially through appropriate structuring of the capstan.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
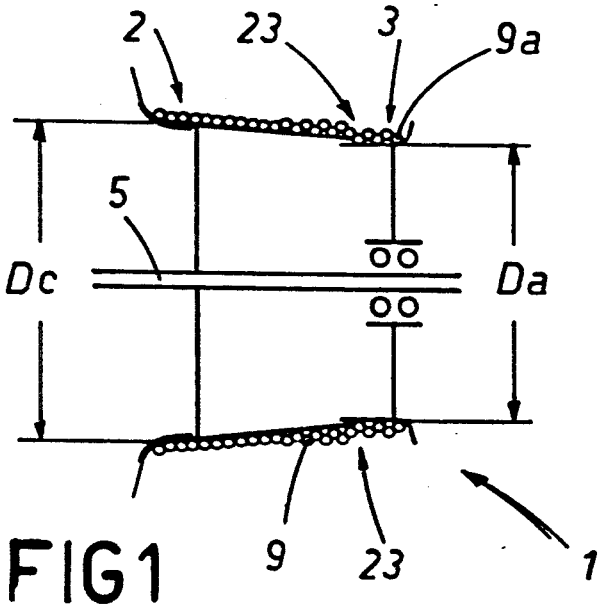
FIG. 1 is a schematic illustration of the structure of a capstan according to the invention.
Figure 3:
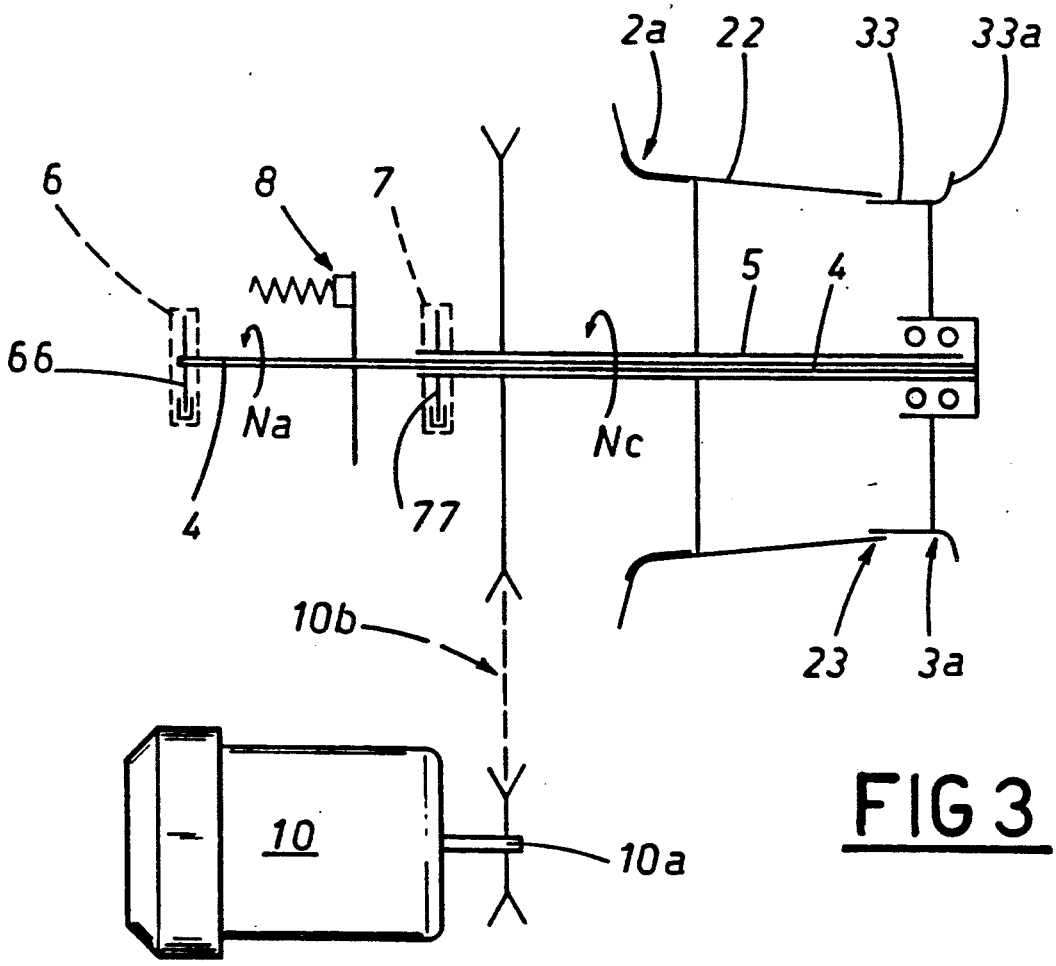
FIG. 3 is a schematic illustration of one capstan, showing the parts essential to the embodiment of a synchronization device characteristic of the wire drawing machine disclosed.
Figure 5:
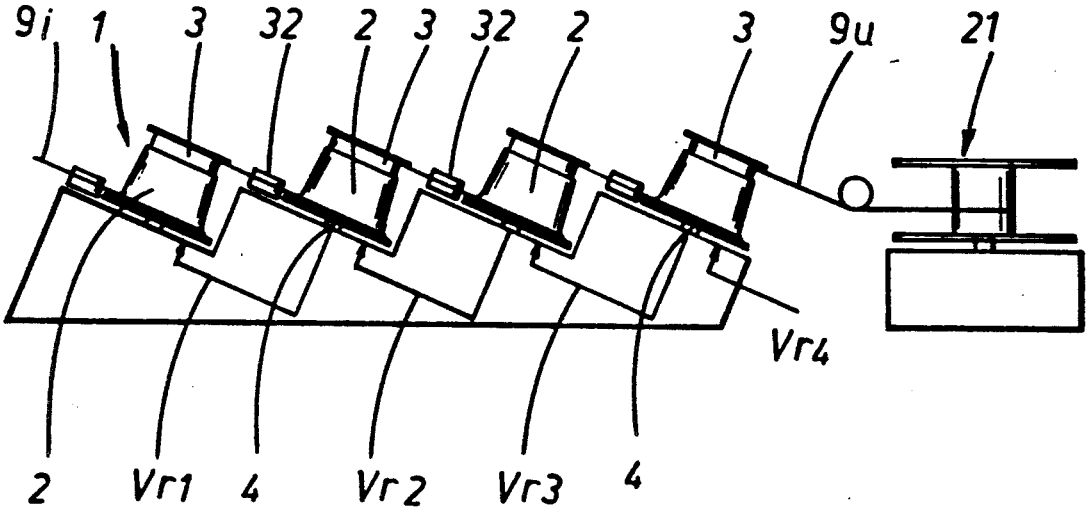
FIG. 5 is a schematic representation of the machine disclosed.

In the general illustration of the machine provided by FIG. 5 of the drawings, 9 denotes the wire, which is fed in at 9*i* and gradually reduced in section to a given production diameter 9*u*, thereafter being recoiled onto a spool 21 at a speed of rotation which adjusts with the increase in the number of coils, hence in their overall diameter, such that the peripheral recoil velocity remains constant. The capstans 1 adopted in the machine disclosed are essentially frustoconical, favoring an ordered distribution of the coiling wire onto the pulling face 2*a* and along to the run-out 3*a* at the top end. More exactly, each capstan 1 is embodied in two distinct concentrically and coaxially disposed parts 2 and 3 (FIGS. 1, 3 and 5), the part denoted 2 being driven by a relative motor 10 of which the shaft 10*a* is coupled via a power transmission 10*b* to a basically conventional capstan drive shaft 5 associated axially with the part 2 in question. The part 2 thus driven appears essentially as a cone frustum 22 disposed coaxially in relation to the remaining part 3.

According to the invention, the part of the capstan denoted 3 consists in a freely revolving tubular ring 33 that provides the run-out 3*a* for the wire 9 and is carried by a relative shaft 4 coaxial with, and, in the case of the example illustrated in the drawings, supported internally of the shaft 5 first mentioned. The ring 33 might be frustoconical, with a taper matched to that of the cone frustum 22, or cylindrical as illustrated. Whichever the case, the ring 33 is embodied with a splayed lip 33*a* serving to restrain the endmost coils of the outrunning wire 9*a*. Each such ring 33 is kept continuously in rotation by the next capstan 1 in line, onto which the wire 9 passes by way of a respective drawing die 32 (see FIG. 5), thereby establishing a given angular velocity Na of the relative shaft 4.

Figure 4:
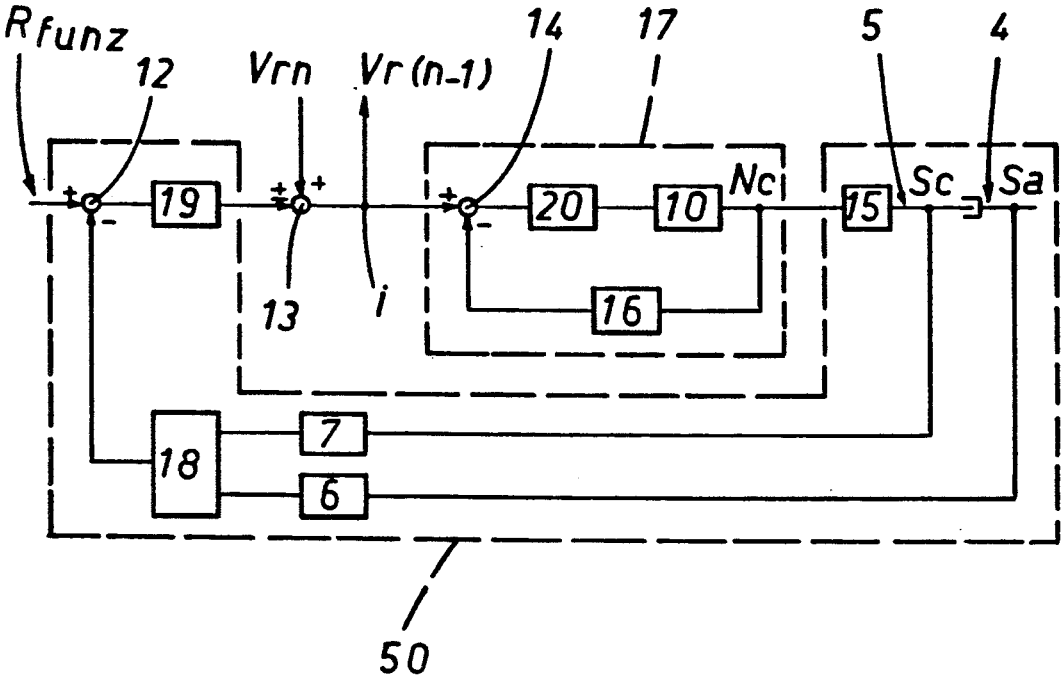
FIG. 4 is a block diagram of the synchronization device.

The wiredrawing machine according to the invention is controlled by a synchronization device 50 (see FIG. 4) designed to correct the rotational speed of the frustoconical part 2 of the capstan whenever a difference occurs between the angular velocity Nc of the driving shaft 5, integrated mathematically and considered as a degree of angular movement Sc, and the angular velocity Na of the shaft 4 of the freely revolving ring 33, similarly integrated and considered as a degree of angular movement Sa, by way of sensors 7 and 6 fitted to the respective shafts 5 and 4 and serving to monitor the angular velocities in question. Preferably, the device 50 will be electric, such that sensing and subsequent integration of the respective angular velocities, occurring at the block denoted 15 in FIG. 4, can be effected to advantage using conventional encoders 66 and 77 fitted to the relative shafts 4 and 5 (see FIG. 3).

Before proceeding with the description of the synchronization device 50, it should be mentioned that each capstan is associated, conventionally, with a speed control feedback loop 17 serving to pilot control of the rotational speed Nc of the motor 10 through a positive or negative signal amplified by the block denoted 20; this signal reflects the difference detected by a comparator 14 between the output signal of a tacho generator 16, fitted to the shaft of the motor 10, and an electrical reference Vrn selected previously and adopted as the capstan speed control parameter. Thus, in addition to this conventional loop 17 and to the encoders 66 and 67 already mentioned, the synchronization device 50 further comprises a dividing circuit 18 by which the output signals from the encoders are reduced to a ratio, and a comparator 12 by which this ratio is subtracted from a previously selected electrical reference value $R_{funz}$ greater than but effectively close to a nominal synchronization value $R_{syn}$ selected for the capstan 1; the difference signal produced by subtraction, amplified by the block denoted 19, can thus be used to effect a correction of the electrical reference Vrn aforementioned if and when synchronization defects should occur.

In operation, wire 9 about to be drawn toward the capstan next in sequence will first coil a given number of times around the ring 33 which, being mechanically independent of the cone frustum 22, rotates at an angular velocity determined by these final coils of wire 9*a*, hence by the destination capstan. Any lack of synchronization will therefore result in the coils around the ring 33 becoming slacker or tighter than those enveloping the cone frustum 22. More exactly, this slacker or tighter coiling action will occur at an area denoted 23, which marks the crossover from the cone frustum 22 to the ring 33. Whilst the endmost coils 9*a* cling tightly to the ring 33 as a result of the pulling force to which they are subject, the preceding coils tend to remain at a substantially constant diameter, given that the flow of material coming onto the pulling face 2*a* of the capstan must match the flow running off at the opposite end 3*a*.

In effect, the fact that the section of the wire 9 remains constant along the capstan signifies that its tangential uncoiling velocity must also remain constant, though only if the diameter of the single coils remains constant likewise.

For example, should an increased pulling force be exerted on the endmost coils 9*a*, as a result of the destination capstan running faster, the freely revolving ring 33 turns faster in response and thus induces a tighter coil at the crossover 23, whereas the speed of the cone frustum 22 remains unchanged (typically slower).

Thus, if Da is the diameter of the ring 33 and Dc the diameter of the wide end of the cone frustum 22 (i.e. the pulling face 2*a*), then uniform surface speeds and nominal synchronization may be expressed as follows:

$$Na \times Da = Nc \times Dc$$

hence:

$$Nc/Na = Da/Dc = R_{syn} < 1$$

Figure 2:
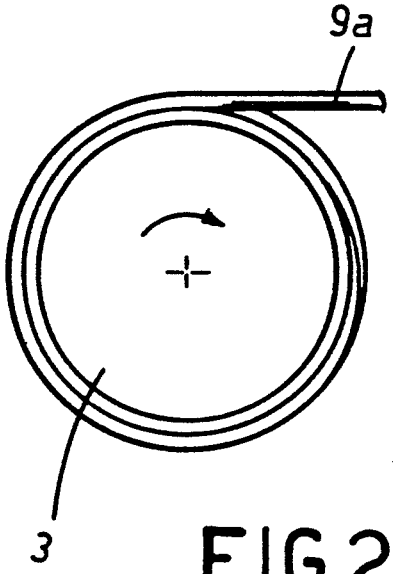
FIG. 2 is a detail of the top end of the capstan.

It will be seen that the ratio between the speeds of the shafts 5 and 4 compensates the difference in diameters. If, therefore, an electrical association is established between the ring 33 and the cone frustum 22, with a ratio between the value of $R_{syn}$ and 1, one has an effective synchronization medium in the margin of tolerance or flow compensation provided by the facility of the coils to tighten or slacken at the crossover 23. Synchronous conditions are therefore maintained, in general, with a value of $R_{funz}$ between the nominal $R_{syn}$ and 1, not least by reason of the fact that the diameter of the final coil 9*a* which drives the ring 33 will almost invariably differ from the diameter denoted Da as the coils are likely, in practice, to bunch or overlap (FIG. 2).

Operation is also possible with a value of $R_{funz}$ greater than 1, though the coils would become too slack ultimately, causing the ring 33 to rotate at an angular velocity Na actually less than Nc, with clearly unacceptable results.

To advantage, the coils at the crossover 23 will be kept as tight as possible (i.e. parametrically near to $R_{syn}$) in order to increase the stability of the coils 9*a* running off the capstan in question, which in turn signifies a value of $R_{funz}$ approaching that of $R_{syn}$ though allowing a margin sufficient at any given moment to maintain a diameter of the coils at the crossover 23 such as permits of accommodating any variation in velocity caused by the relative tightening or slackening action. Thus, by adopting a suitable value of $R_{funz}$, which would be greater in any event than that of $R_{syn}$ and selected preferably with the system in operation, the best possible synchronization will be achieved from a practical standpoint.

A preferred embodiment of the machine will also include a brake 8 associated with the free-running shaft 4, which enables bi-directional reaction and inertia of the ring 33 in response to variations in drag on the wire caused by corresponding variations in the tangential velocity of the capstan 1 next in sequence. This in turn renders the response of the encoders 66 and 67 instantaneous, by virtue of the fact that the endmost coils 9*a* remain permanently in contact with the surface of the ring 33 whatever the conditions.

An example of the practical application of such a device 50 is illustrated in FIG. 5, where it will be seen that the electrical reference signal Vrn for a given capstan coincides with the input "i" to the speed control feedback loop 17 of the capstan next in sequence (see also FIG. 4), whilst the value $Vr_{(n-1)}$ of the input "i" to the feedback loop 17 of the capstan first mentioned provides the Vrn reference for the capstan preceding in sequence. In partiuclar, it will be observed that the reference Vr1 serving the first capstan of FIG. 52 is supplied by the following capstan, likewise the signals Vr2 and Vr3 supplied to the next two capstans, whereas the reference Vr4 supplied to the final capstan is dependent on the tangential velocity of the out-running wire 9*u* and matched to the peripheral velocity of the spool 521.

What is claimed is:

1. A non-slip rectilinear wiredrawing machine for drawing wire through a successive series of synchronized capstans, comprising:

a plurality of tangentially uncoiling capstans, each of said capstans embodied in two distinct concentric and coaxial parts, a first part of said capstan having a sole pulling face and a support shaft, said shaft being driven in rotation by a motor, a second part of said capstan having a freely-revolving tubular ring of diameter smaller than that of the pulling face and affording a run-out from which wire is drawn by a successive capstan;

a die disposed between adjacent capstans;

a sensing means for independantly monitoring the angular displacement of each of said first and said second parts of said capstan;

a synchronization means for instantaneously correcting the difference in angular velocity between said first and said second parts of said capstan in response to a difference in the angular displacement as detected by said sensing means.

2. The wiredrawing machine of claim 1, wherein said freely-revolving tubular ring is cylindrical in shape and exhibits a terminal lip serving to restrain said wire.

3. The wiredrawing machine of claim 1, wherein said first part of said capstan is tapered and said freely-revolving tubular ring is frustoconical in shape, said ring exhibiting a taper identical to that of said first part of said capstan and a splayed terminal lip serving to restrain said wire.

4. The wiredrawing machine of claim 1, wherein said freely-revolving tubular ring is supported by a rotatable shaft coaxial to said motor driven support shaft.

5. The wiredrawing machine of claim 4, wherein said sensing means includes a rotary encoder disposed on each of said shafts and generates a signal proportional to the angular displacement of each respective shaft.

6. The wiredrawing machine of claim 5, having electrical feedback speed control means for controlling the angular velocity of said first part of said capstan wherein said synchronization means further comprises:

a dividing circuit means for generating a ratio signal based on said signals generated by said encoders;

a first comparator means for generating a first correction signal based on said ratio signal and a first reference signal of value marginally greater than a nominal capstan speed synchronization electrical reference signal, said nominal reference signal value always being less than unity and proportional to a ratio of the diameter of said freely-revolving ring and the diameter of the pulling face of said first part of said capstan;

a second comparator means for generating a second correction signal applied to said speed control means, said second correction signal based on said first correction signal and a second reference signal whereby said wire is firmly coiled about an interface between said first part of said capstan and said freely-revolving tubular ring and whereby tension on said wire coils is adjusted in response to variations in angular velocity of the successive capstan.

7. The wiredrawing machine of claim 4, wherein braking means associated with said support shaft of each freely-revolving tubular ring enables bi-directional displacement of said ring in response to variations in tension on said wire produced by corresponding variations in the angular velocity of the successive capstan, whereby the response of said sensing means is instantaneous and said coils of wire remain firmly in contact with the ring.

8. The wiredrawing machine of claim 5, wherein braking means associated with said support shaft of each freely-revolving tubular ring enables bi-directional displacement of the ring in response to variations in tension on said wire produced by corresponding variations in the angular velocity of the successive capstan, whereby the response of said sensing means is instantaneous and said coils of wire remain firmly in contact with the ring.

9. The wiredrawing machine of claim 6, wherein braking means associated with said support shaft of each freely-revolving tubular ring enables bi-directional displacement of the ring in response to variations in tension on said wire produced by corresponding variations in the angular velocity of the successive capstan, whereby the response of said sensing means is instantaneous and said coils of wire remain firmly in contact with the ring.

10. The wiredrawing machine of claim 6, wherein the electrical reference utilized in controlling the rotational speed of a given capstan coincides with the input to the speed control feedback loop of the capstan next in sequence, whilst the value registering at the input to the feedback loop of the capstan thus controlled provides the electrical reference for control of the capstan preceding in sequence.

* * * * *